United States Patent [19]

Barbeau

[11] 4,277,222

[45] Jul. 7, 1981

[54] TURBINE ENGINE COMPRESSOR

[75] Inventor: Dennis E. Barbeau, Temperance, Mich.

[73] Assignee: Teledyne Industries, Inc., Los Angeles, Calif.

[21] Appl. No.: 2,659

[22] Filed: Jan. 11, 1979

[51] Int. Cl.[3] ..... F01D 5/08

[52] U.S. Cl. ..... 415/177; 415/212 A

[58] Field of Search ..... 415/177, 178, 200, 212 R, 415/212 A

[56] References Cited

U.S. PATENT DOCUMENTS

| | | | |
|---|---|---|---|
| 2,304,259 | 12/1942 | Karrer | 415/212 A X |
| 3,801,353 | 4/1974 | Brill-Edwards | 415/212 A X |
| 4,122,673 | 10/1978 | Leins | 415/212 A X |

*Primary Examiner*—Stanley N. Gilreath

*Attorney, Agent, or Firm*—Gifford, Van Ophem, Sheridan & Sprinkle

[57] ABSTRACT

In a turbine engine of the type having a centrifugal air compressor open at one end to a combustion chamber, the improvement which comprises coating the back face of the air compressor with a thermal insulating material, such as zirconium oxide. The thermal insulating material effectively insulates the relatively cool air compressor from hot leakage gases from the combustor and subsequent turbine engine components thus minimizing thermal strain on the compressor and enabling higher compressor speeds and pressure ratios and/or reduced compressor weight.

6 Claims, 2 Drawing Figures

TURBINE ENGINE COMPRESSOR

BACKGROUND OF THE INVENTION

I. Field of the Invention

The present invention relates generally to turbine engines and, more particularly, to an improved air compressor design for such turbine engines.

II. Description of the Prior Art

In general, a gas turbine engine comprises an air compressor, a combustion chamber or combustor, and an expander or turbine wheel which is usually coaxially mounted on the same shaft as the air compressor. One end of the air compressor is open to inlet air while the other end or final stage of the air compressor is open via a fluid passageway to the combustion chamber so that the air compressor supplies compressed air to the combustion chamber. Fuel is introduced within the combustion chamber and ignited so that the resulting hot and expanding gases exhaust through and rotatably drive the turbine wheel. Since the turbine wheel and air compressor are secured to the same shaft, the turbine wheel rotatably drives the air compressor.

In a gas turbine engine the inlet air to the compressor is relatively cool compared to the air leaving the compressor and entering the combustion chamber. One inherent disadvantage of these previously known gas turbine engines is that a certain amount of the hot compressor discharge gas leaks from the combustion chamber and up the back face of the final compressor stage due to the pressure differential. Additionally, heat can be conducted to the compressor from the expander or turbine wheel since both are mounted onto a common main shaft. This leakage of hot gases undesirably heats the final compressor stage causing thermal strain and reducing the material structural properties. This, in turn, either limits the rotational speeds at which the compressor can rotate without structural fatigue and/or failure thus directly limiting both the pressure output from the compressor and the overall efficiency of the turbine engine, or requires increased structure to be added to provide the necessary structural capability, adding weight and cost to the engine.

The previous attempts to limit this leakage of hot gases have heretofore been directed toward improvements in the labyrinth seal between the compressor impeller back face and the compressor cover. Even the improved labyrinth seals, however, are ineffective in completely stopping this leakage of hot gases. Moreover, this leakage of hot gases and the resultant thermal strain on the air compressor has become an increasingly serious problem with the trend of increasing cycle pressure ratios, which increase the temperature of the leakage gases in an effort to increase the turbine engine efficiency.

SUMMARY OF THE PRESENT INVENTION

The present invention provides a means for simply, but effectively, minimizing the adverse effects of gas leakage from the hot portions of the turbine engine and to the back face of the relatively cool compressor.

In brief, the present invention achieves this by providing a coating of thermal insulating material on the back face of the final compressor stage to thermally insulate the compressor components from these hot leakage gases. By doing so, thermal strain on the compressor components is minimized which enables higher compressor rotational speeds without fatigue or failure.

Higher compressor rotational speed in turn produces higher compressed air ratios and thus overall higher turbine engine efficiency.

Different types of thermal insulating materials can be applied to the back face of the compressor without deviating from the scope of the invention. For example, ceramic coatings of the type currently employed in the hot turbine engine areas, but never before employed in the relatively cool engine areas such as the compressor, effectively protect the compressor from thermal strain. Similarly, zirconium oxide is another preferred thermal insulator in that it can be easily sprayed onto the back face of the turbine compressor.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which.

DETAILED DESCRIPTION OF THE PRESENT INVENTION

Figure 1:
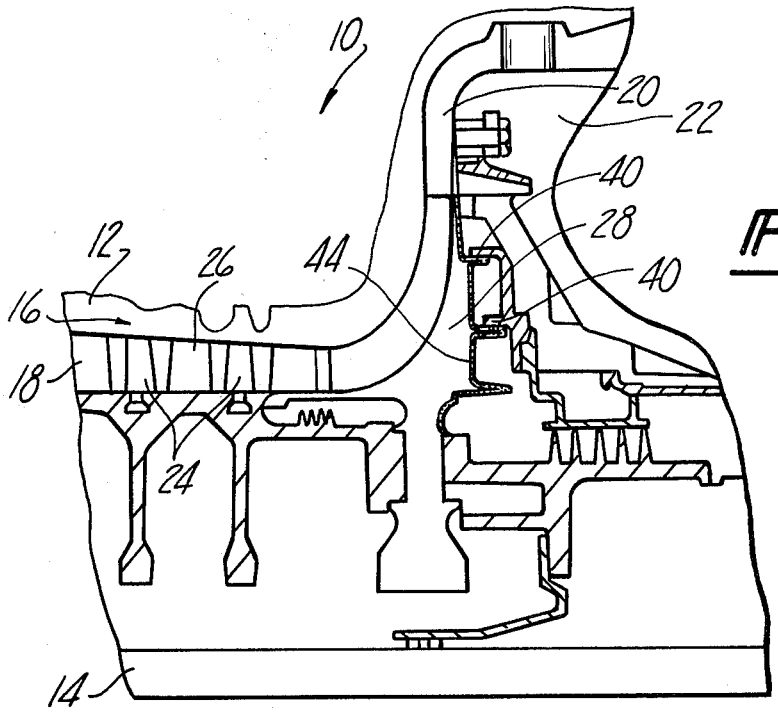
FIG. 1 is a fragmentary sectional view showing a portion of a turbine engine employing the compressor design of the present invention.

With reference to the drawing, a portion of a turbine engine 10 is thereshown having a support housing 12 in which a main shaft 14 is rotatably journalled by conventional means, not shown. Also, in the conventional fashion, the turbine engine 10 includes an air compressor 16 which receives relatively cool inlet air at one end 18 and exhausts compressed and heated air via a radial diffuser 20 to a combustion chamber or turbine engine combustor 22. The hot and expanding gases resulting from the combustion of the compressed air and injected fuel in combustion chamber 22 exhaust through and rotatably drive the turbine wheels (not shown) which form the expander for the turbine engine 10. The turbine wheels and the air compressor are both mounted to the turbine main shaft 14 so that the turbine wheels rotatably drive the compressor 16.

Although the air compressor 16 may be of any conventional construction, it typically comprises a plurality of axially spaced stages wherein each stage includes a plurality of circumferentially spaced compressor vanes 24, all of which are connected to the turbine main shaft 14. In addition, conventionally a series of circumferentially spaced stator vanes 26 are connected to the compressor support housing 12 and are stationary with respect to the main shaft 14. The stator vanes 26 are positioned between and direct the air flow from one compressor stage to the next. The pressure or compression of the air through the air compressor 16 increases axially from the air compressor inlet 18 through its outlet 20.

Figure 2:
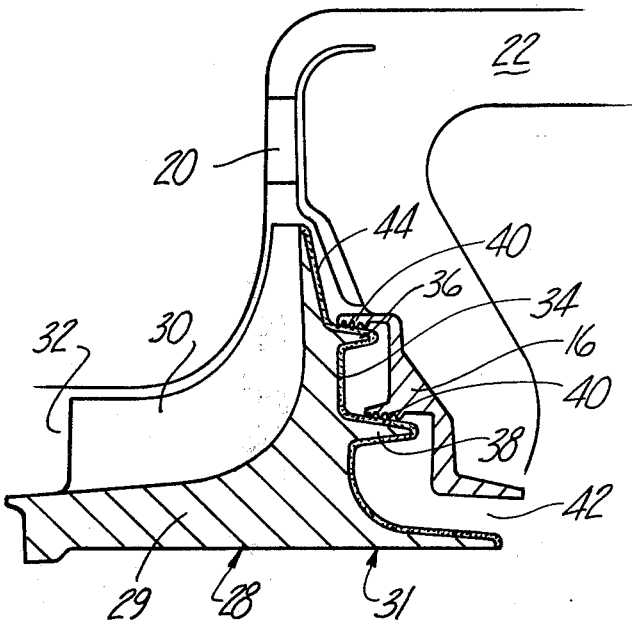
FIG. 2 is a fragmentary sectional view of the final compressor stage and enlarged for clarity.

The innermost or final stage 28 of the air compressor, best shown in FIG. 2, is an impeller 31 which includes a hub 29 generally conical in shape and with a plurality of circumferentially spaced arcuate vanes 30 formed about its periphery (only one of which is shown). The final stage 28 of the compressor 16 axially receives air from one axial end 32 and further compresses and pumps the air radially outwardly into the diffuser passage 20 and to the turbine engine combustor 22.

The final compressor stage 28 includes a back face 34 having two radially spaced and axially extending surfaces 36 and 38 formed annularly therearound. Labyrinth seals 40 are mounted to the support housing 12 and engage the annular surfaces 36 and 38 to minimize the leakage of hot gases from the compressor discharge and along the back face 34 of the impeller 31. Without the seals 40 excessive hot gas leakage would occur along the back face 34 from near the main shaft 14 at 42 and to the passageway 20.

The novelty of the instant invention, however, resides in a coating 44 of thermal insulating material along the back face 34 of the impeller 31. This coating 44 of thermal insulating material can comprise any of a number of different materials such as the ceramic materials currently employed in the hot engine areas of turbine engines. Zirconium oxide also forms a preferred material for the coating 44 in that it can be easily and simply sprayed on the back face 34 of the impeller 31. Other materials, such as yttrium, can also be employed as the coating while remaining within the scope and intent of the invention.

In operation, the thermal insulating coating 44 on the back face 34 of the impeller 31 prevents the heating of the impeller 31 from the hot leakage gases flowing thereacross as a result of recirculation of the hot compressor discharge air from the combustor. Instead, these hot leakage gases are expelled along with the compressed air from the impeller 31 and into the passageway 20 to the turbine engine combustor 22. In this manner, the thermal insulating coating simply, but effectively prevents thermal strain and radial tip growth of the vanes 36 and enables higher rotational speeds for the impeller 31 without impeller 31 fatigue and/or failure. Moreover, the thermal insulating coating 44 insulates the compressor inlet air and the bore air between the impeller 31 and the turbine main shaft 14 which are cool relative to leakage air 42 from the leakage air to thereby reducing undesirable thermal gradients across the impeller 31. This in turn enables higher rotational speeds, pressure ratios and higher operating efficiency for the turbine engine.

Having described my invention, however, many modifications thereto will become apparent to those skilled in the art to which it pertains without deviation from the spirit of the invention as defined by the scope of the appended claims.

I claim:

1. In a turbine engine having a support housing and a shaft means rotatably mounted within the support housing, an air compressor means connected to the shaft means for axially compressing air from an inlet end to an outlet end, said compressor means including an impeller at its outlet end for directing the compressed air through a passageway and into a combustion chamber, said impeller having an annular and substantially radially extending back face at the outlet end of the compressor, the improvement which comprises:

a coating of thermal insulating material on the back face of the impeller whereby said thermal insulating coating thermally insulates the impeller from hot leakage gases along the back face of the impeller.

2. The invention as defined in claim 1 wherein said thermal insulating coating comprises zirconium oxide.

3. The invention as defined in claim 2 wherein said zirconium oxide coating is sprayed onto the back face of the impeller.

4. The invention as defined in claim 1 wherein the thermal insulating coating comprises a ceramic material.

5. The invention as defined in claim 1 and including sealing means between said support housing and said impeller.

6. The invention as defined in claim 1 wherein said thermal insulating coating comprises yttrium.

* * * * *